US005365740A

United States Patent [19]

Kikkawa et al.

[11] Patent Number: 5,365,740

[45] Date of Patent: Nov. 22, 1994

[54] REFRIGERATION SYSTEM FOR A NATURAL GAS LIQUEFACTION PROCESS

[75] Inventors: Yoshitsugi Kikkawa; Osamu Yamamoto; Kenrou Ohmori; Motohiro Ohmori; Noriyoshi Nozawa, all of Kanagawa, Japan

[73] Assignee: Chiyoda Corporation, Kanagawa, Japan

[21] Appl. No.: 28,479

[22] Filed: Mar. 8, 1993

[30] Foreign Application Priority Data

Jul. 24, 1992 [JP] Japan ..... 4-218505
Jan. 21, 1993 [JP] Japan ..... 5-024924

[51] Int. Cl.[5] ..... F25J 3/06

[52] U.S. Cl. ..... 62/23; 62/36; 165/166

[58] Field of Search ..... 62/23, 36; 165/166

[56] References Cited

U.S. PATENT DOCUMENTS 3,932,156 1/1976 Stern ..... 62/23
3,992,168 11/1976 Toyama et al. ..... 62/36
4,242,875 1/1981 Schaefer ..... 62/23
4,721,164 1/1988 Woodward ..... 62/36
5,144,809 9/1992 Chevalier et al. ..... 165/166
5,207,065 5/1993 Lavin et al. ..... 165/166

*Primary Examiner*—Ronald C. Capossela
*Attorney, Agent, or Firm*—Skjerven, Morrill, MacPherson, Franklin & Friel

[57] ABSTRACT

Provided is an improved refrigeration system for pre-cooling natural gas or cooling a mixed refrigerant for natural gas liquefaction in a propane refrigeration process widely used for the liquefaction of natural gas. The system comprises a plurality of plate-fin heat exchangers preferably arranged in a parallel relationship for passing a propane refrigerant as a vertical flow and pre-cooling natural gas or cooling a mixed refrigerant for liquefying natural gas, and a thermo siphon drum for the propane refrigerant consisting of a horizontally disposed, laterally elongated tank. Because the passages of the heat exchanger for the natural gas or the mixed refrigerant extend over their entire length in mutually separate relationship, even when the propane refrigerant, the natural gas or the mixed refrigerant is in both gas and liquid phases, a high efficiency of heat transfer can be attained, and the size of the heat exchanger can be reduced. In particular, from an economic view point, it is preferable if the thermo siphon drum serves also as a flash tank.

9 Claims, 9 Drawing Sheets

REFRIGERATION SYSTEM FOR A NATURAL GAS LIQUEFACTION PROCESS

TECHNICAL FIELD

The present invention relates to a refrigeration system for pre-cooling natural gas or cooling a mixed refrigerant for liquefying natural gas in a refrigeration process using a propane refrigerant which is widely used for a natural gas liquefaction process.

BACKGROUND OF THE INVENTION

In a normal natural gas liquefaction process, as illustrated in FIG. 1, high pressure natural gas from which acid gases such as $CO_2$ and $H_2S$ are removed is cooled to approximately 20° C. in a shell and tube heat exchanger 1 through which HHP propane is passed so that a majority of the water content in the natural gas may be removed and separated in a drum 2. Then, the water content is further reduced to the order of 1 wt ppm in a dryer 3, and the natural gas is cooled to 0° C. in a shell and tube heat exchanger 4 through which HP propane is passed. The natural gas is further cooled in a shell and tube heat exchanger 5 through which MP propane is passed, and is cooled in a shell and tube heat exchanger 6 through which LP propane is passed before it is supplied to a scrub column 7 where heavy fractions are removed.

Then, as illustrated in FIG. 2, the natural gas is cooled to −145° C. and liquefied by exchanging heat with a mixed refrigerant in a main heat exchanger 8. This stream is flashed twice in drums 9 and 10 so as to be removed of its $N_2$ content, and is fed to a storage facility by a pump 11 as LNG at its boiling point under the atmospheric pressure.

Meanwhile, in the mixed refrigerant cycle, as illustrated in FIG. 2, after the mixed refrigerant has exchanged heat with the natural gas in the main heat exchanger 8, the mixed refrigerant is fed to a LPMR compressor 12 at 3 bar, −30° C., and it is pressurized to 13 bar by the compressor 12, and cooled to the ambient temperature in an after-cooler 13. It is then pressurized to 25 bar in a HPMR compressor 14, and again cooled to the ambient temperature in an inter-cooler 15 before it is further pressurized to 40 bar by the HPMR compressor 14. The thus pressurized mixed refrigerant is cooled to the ambient temperature in an after-cooler 16, and is then further cooled to 15° C. by HHP propane in a shell and tube heat exchanger 17, to 0° C. by HP propane in a shell and tube heat exchanger 18, to −10° C. by MP propane in a shell and tube heat exchanger 19, and to −25° C. by LP propane in a shell and tube heat exchanger 20.

In this case, the mixed refrigerant starts partial condensation in the shell and tube heat exchanger 17, and is three quarters condensed in the shell and tube heat exchanger 20. It is then introduced into a separation drum 21 where the separated gas and liquid are passed through the main heat exchanger 8 for exchanging heat with the natural gas.

Now consider an example of an LNG plant with a capacity of 2.6 million tons per year. The (kettle type) shell and tube heat exchangers 1, 4, 5 and 6 that are to be cooled by propane are each required to be a large kettle type heat exchanger on the order of 1,000 to 2,000 $m^2$, and the shell and tube heat exchangers 17, 18, 19 and 20 are each required to be a large kettle type heat exchanger on the order of 2,000 $m^2 \times 2$. Such heat exchangers are so large in size that they are not suitable for land transportation, and the cost for the foundation and other construction work is substantial.

Further, since the natural gas or the mixed refrigerant enters these shell and tube heat exchangers 5, 6, 18, 19 and 20 in mixed phases, the liquid to gas ratio of the stream in each part of the tubes deviates so much from a theoretical value that the performance of the heat exchangers inevitably drops.

BRIEF SUMMARY OF THE INVENTION

In view of such problems of the prior art, a primary object of the present invention is to provide an improved refrigeration system for pre-cooling natural gas or cooling a mixed refrigerant for natural gas liquefaction in a propane refrigeration process widely used for the liquefaction of natural gas.

A second object of the present invention is to provide a refrigeration system of the above mentioned type which is economical to construct, and highly efficient in operation.

According to the present invention, such objects can be accomplished by providing a refrigeration system for pre-cooling or cooling a mixed refrigerant for liquefying natural gas by using a propane refrigerant in a natural gas liquefaction process, comprising: a plate-fin heat exchanger including a plurality of passages for the natural gas or the mixed refrigerant which extend in a mutually separated relationship substantially over an entire length thereof, the propane refrigerant being passed vertically in the plate-fin heat exchanger; and a separation drum for the propane refrigerant consisting of a laterally elongated, horizontally disposed tank connected to the plate-fin heat exchanger. To reduce costs, the separation drums may each consist of a thermo siphon drum which preferably serves also as a flash tank.

The present invention also provides a refrigeration system for pre-cooling natural gas or cooling a mixed refrigerant for liquefying natural gas by using a propane refrigerant in a natural gas liquefaction process, comprising: a supply source of a propane refrigerant; an expansion device for depressurizing the propane refrigerant supplied from the supply source; a separation drum for separating the propane refrigerant obtained from the expansion device into a gas fraction and a liquid fraction; a heat exchanger for cooling natural gas or a mixed refrigerant for liquefying natural gas, wherein the heat exchange uses the propane refrigerant obtained from the separation drum as boiling liquid and, after exchange, returns the propane refrigerant consisting of a mixture of vapor and liquid after to the separation drum; a next-stage expansion device for extracting and depressurizing a part of the propane refrigerant obtained as liquid from the separation drum; a next-stage separation drum for separating the propane refrigerant obtained from the next-stage expansion device as a mixture of vapor and liquid into a gas fraction and a liquid fraction; a next-stage heat exchanger for cooling natural gas or a mixed refrigerant for liquefying natural gas with the propane refrigerant obtained from the next-stage separation drum as boiling liquid, and returning the propane refrigerant consisting of a mixture of vapor and liquid after heat exchange to the next-stage separation drum; and a vapor conduit for returning the propane refrigerant obtained from the next-stage separation drum as vapor to the supply source; the heat exchangers each consisting of a plate-fin heat exchanger in which a plurality of passages for the natural gas or the mixed refrigerant extend over an entire length thereof in mutually separated relationship with the propane refrigerant being passed vertically in the plate-fin heat exchanger; the separation drums each consisting of a horizontally disposed, laterally elongated drum connected to the corresponding plate-fin heat exchanger as a thermo siphon drum for the propane refrigerant.

By using a plate-fin heat exchanger having a ten times larger heat transfer area per unit volume than a shell and tube heat exchanger, the above mentioned cost can be reduced. By combining a number of heat exchangers into a single plate-fin heat exchanger and thereby reducing the amount of piping between different heat exchangers, a suitable heat transfer area can be obtained without excessively increasing the overall size of the heat exchanger. An example of plate-fin heat exchanger that can be used for such a purpose is disclosed in Japanese patent publication (kokoku) No. 58-55432 and U.S. Pat. No. 4,330,308. The problem with the prior art that a desired heat transfer efficiency cannot be obtained due to the fact that the natural gas or the mixed refrigerant consists of mixed phases can be avoided by keeping the passages within the plate-fin heat exchanger separate from each other throughout the length of the plate-fin heat exchanger. With the view of maintaining the efficiency of the system even in a partial capacity operation, the stream flow may be directed vertically downward or horizontally in the cases of the natural gas and the mixed refrigerant, and vertically upwards in the case of the propane.

BRIEF DESCRIPTION OF THE DRAWINGS

The present invention is described in the following with reference to the appended drawings, in which.

DETAILED DESCRIPTION OF THE PREFERRED EMBODIMENTS

Figure 2:
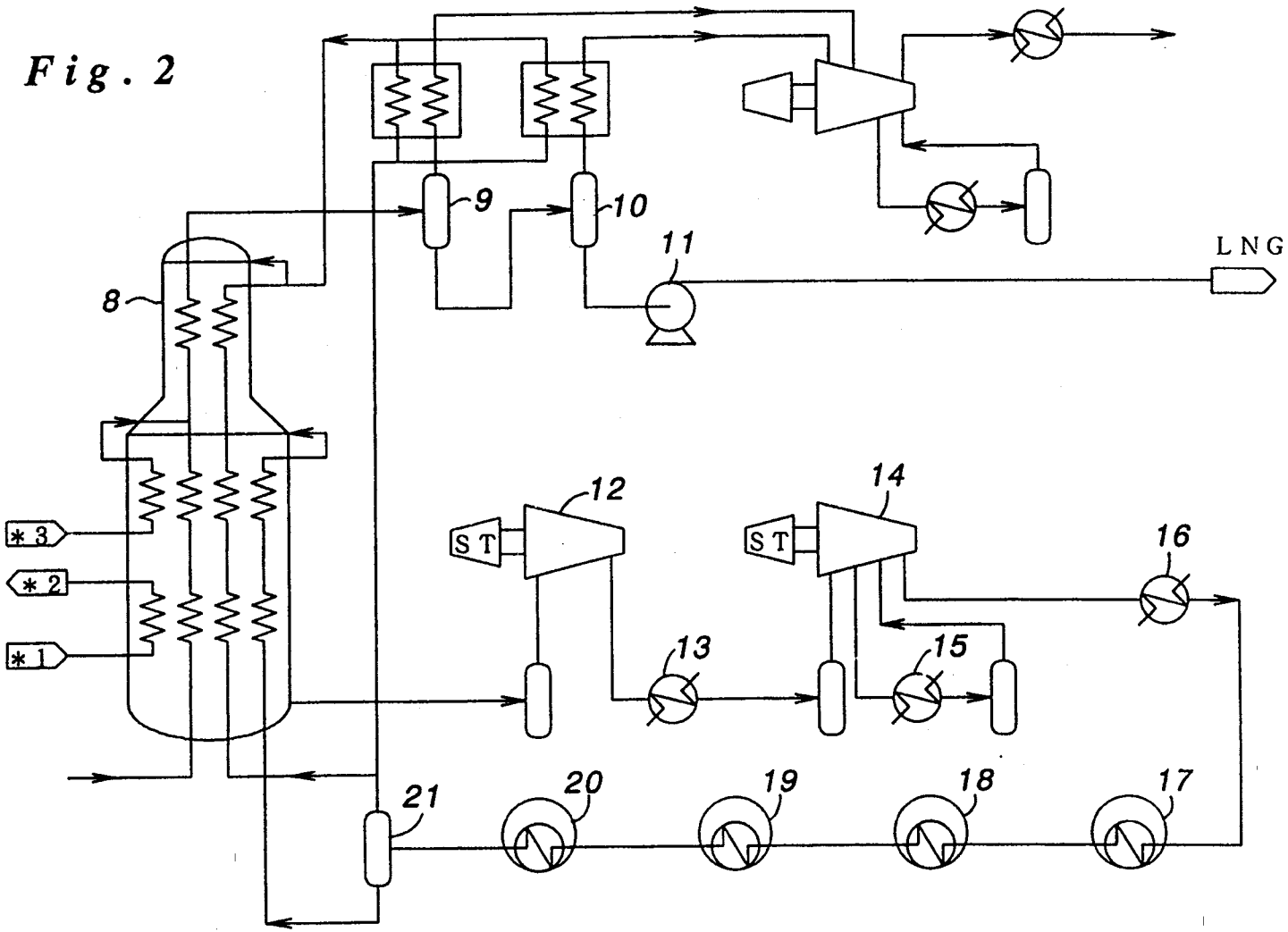
FIG. 2 is a diagram illustrating a liquefying device for natural gas in a natural gas liquefaction process to which a refrigeration system using a propane refrigerant according to the present invention is applied.
Figure 3:
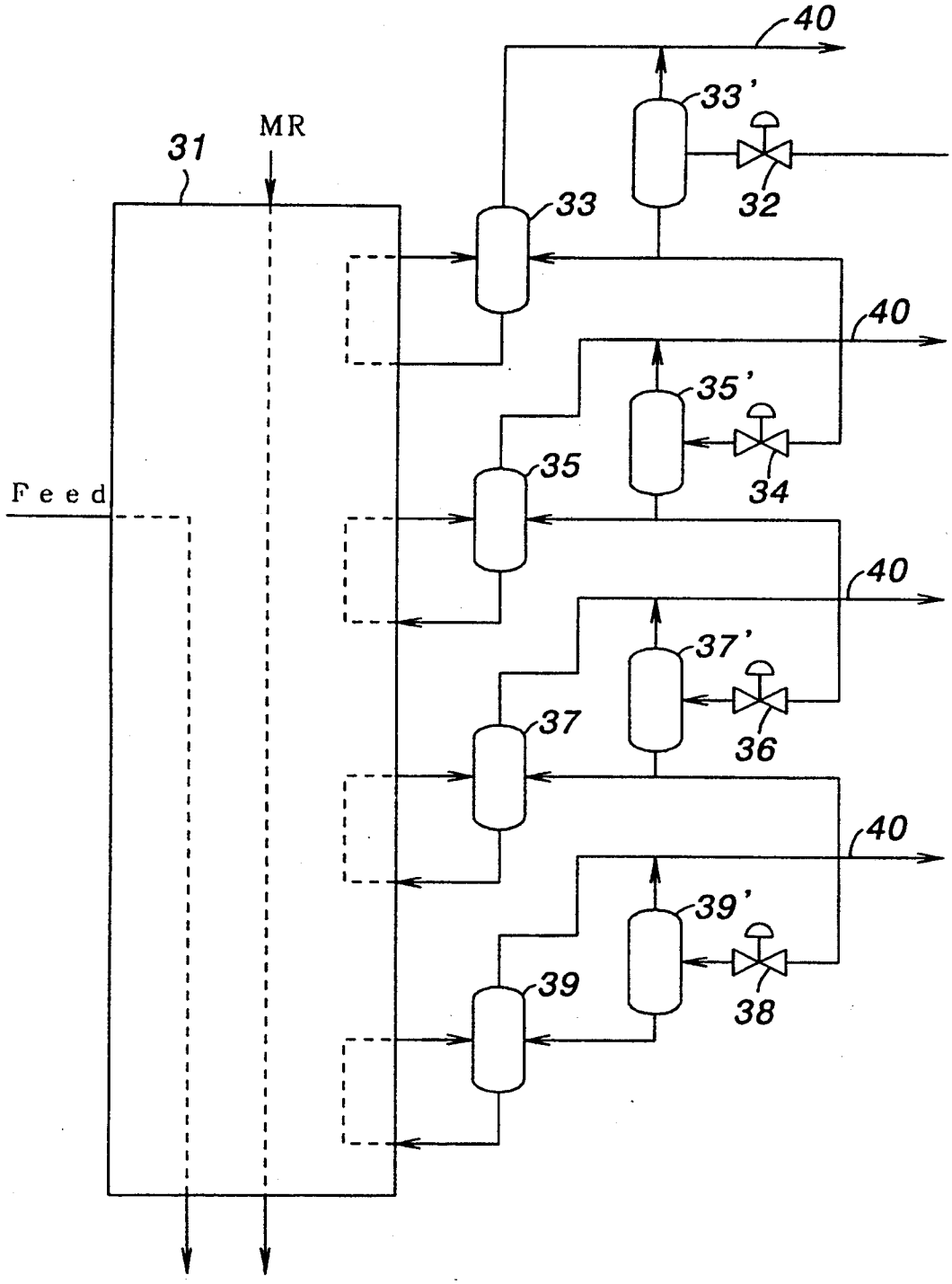
FIG. 3 is a diagram showing an essential part of a first embodiment of the refrigeration system according to the present invention.

FIG. 3 shows an essential part of a propane refrigeration system according to the present invention employing a plate-fin heat exchanger 31 in place of the heat exchangers 17, 18, 19 and 20 illustrated in FIG. 2, and numerals 33, 35, 37 and 39 denote thermo siphon drums while numerals 33', 35', 37', and 39' denote flash drums for preparing low pressure propane refrigerants. In the present embodiment, four thermo siphon drums are provided for each plate-fin heat exchanger 31.

The liquefied propane at 15 bar, 43° C. is converted by a regulating valve 32 into HHP propane at 7 bar, 10° C., and is introduced into the flash tank 33' in mixed phases. It is then separated into a gas fraction and a liquid fraction, and the gas fraction is returned to the compressor and other parts of the propane refrigeration system via a conduit 40 while the liquid fraction is fed to the thermo siphon drum 33 eventually to be circulated in the heat exchanger 31, a part of the liquid fraction being converted into HP propane at 5 bar, −5° C. by a regulating valve 34 in mixed phases before it is supplied to the flash tank 35' in the next stage. The propane which has circulated the heat exchanger 31 exchanges heat with the mixed refrigerant in the heat exchanger 31, and is partly evaporated before it is returned to the thermo siphon drum 33. The gas fraction which has been separated in the thermo siphon drum 33 is also returned to the propane refrigeration system via the conduit 40. The thermo siphon drums 35, 37 and 39, the flash tanks 35', 37' and 39', and the regulating valves 36 and 38 in the subsequent stages operate in similar fashion, and their operation will be understood without any further description.

Figure 1:
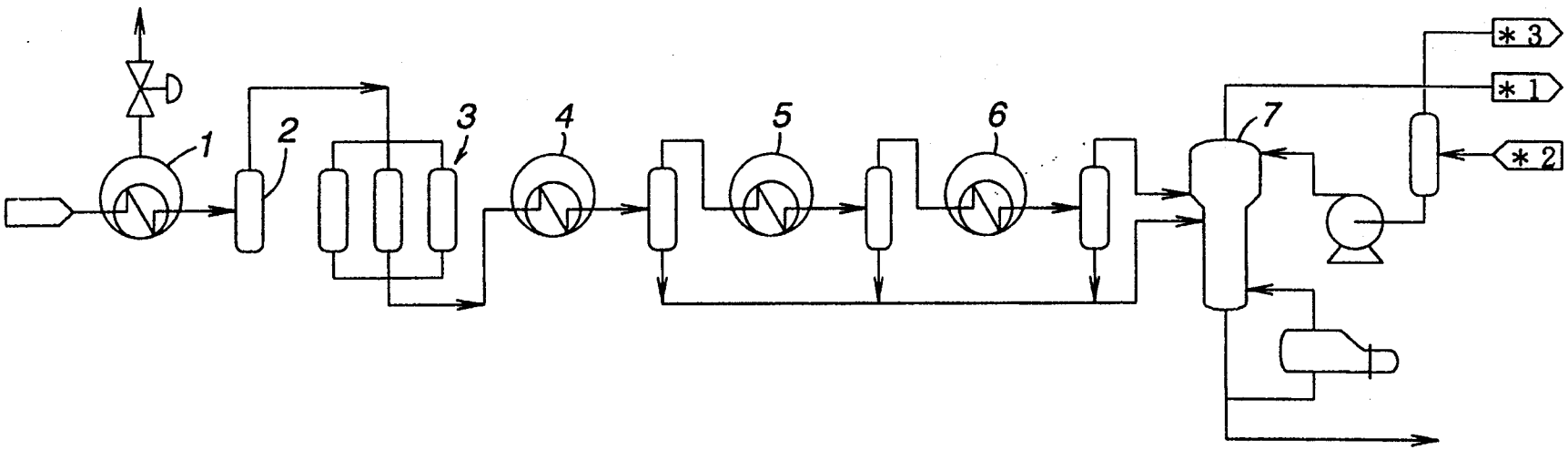
FIG. 1 is a diagram illustrating a pre-cooling device for natural gas in a natural gas liquefaction process to which a refrigeration system using a propane refrigerant according to the present invention is applied.

A plate-fin heat exchanger can also be used for cooling natural gas in place of the heat exchangers 4, 5 and 6 of FIG. 1 and operates in a similar fashion. However, when natural gas is to be cooled, it is preferable not to exchange heat with the HHP propane in the plate-fin heat exchanger to prevent the generation of hydrates. Instead, because it is necessary to rigorously control the temperature of the HHP propane, the heat exchange can be most conveniently carried out by using a shell and tube heat exchanger provided separately from the plate-fin heat exchanger 31.

In a base load LNG plant having a capacity of 2.6 million tons per year, in theory, six to eight plate-fin heat exchangers 31 of the largest possible size are necessary, and if separation drums such as thermo siphon drums are installed for each plate-fin heat exchanger an extremely large cost is incurred. Therefore, it is conceivable to provide a large vertical separation drum for the propane at each different level, to distribute the liquid fraction to each of the plane fin heat exchangers via a header, and to return the propane in mixed phases expelled from each of the plate-fin heat exchangers to the separation drums by collecting the various conduits to the header.

Figure 4:
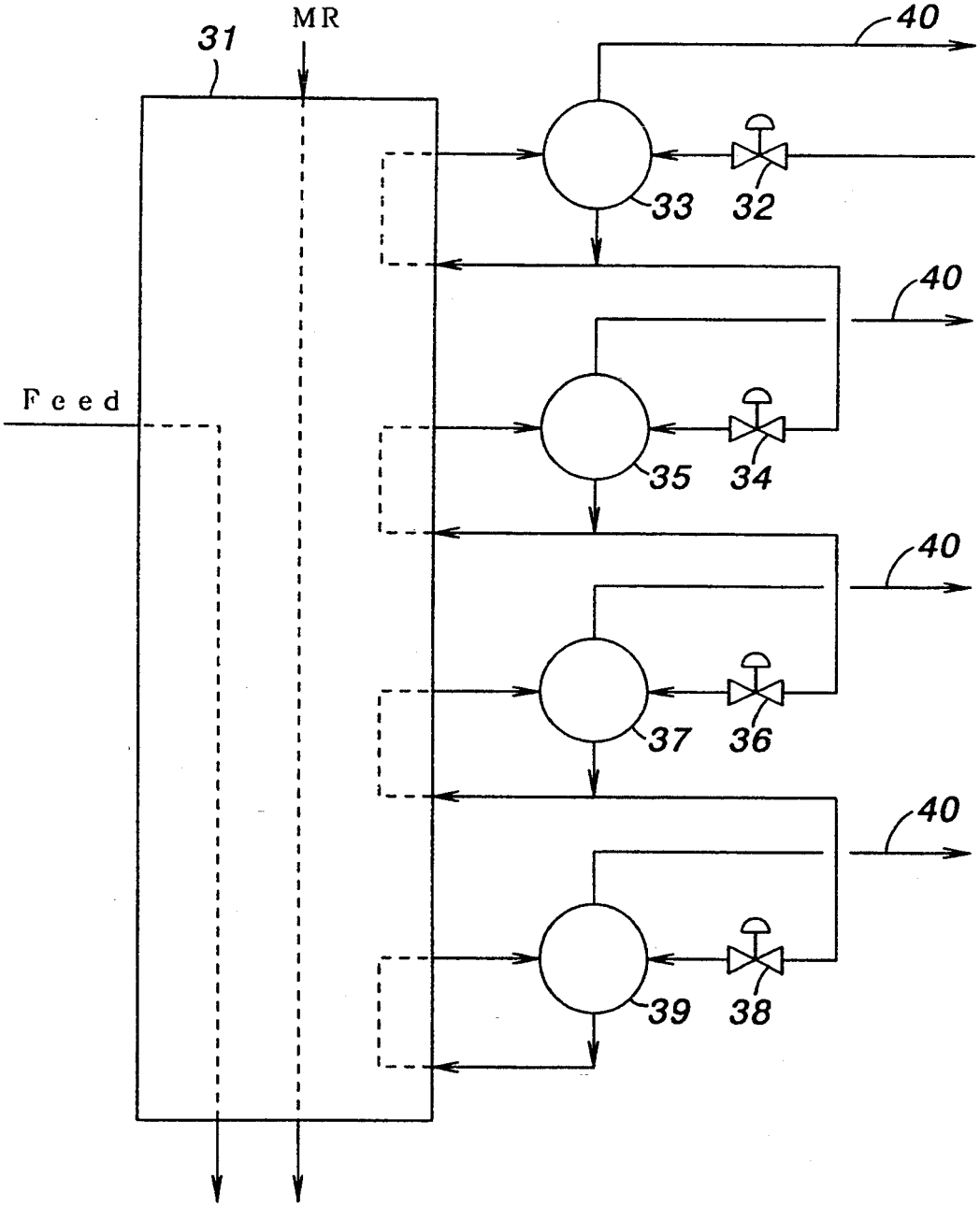
FIG. 4 is a diagram showing an essential part of a second embodiment of the refrigeration system according to the present invention.

According to the Inventors' discovery, by preventing the formation of bubbles in the liquid in the inlet end of each of the thermo siphon drums, using horizontal baffles, for example, it is possible to assign the function of a flash tank to the gas and liquid separator of the thermo siphon, and thereby reduce costs. A flow diagram showing the outline of an embodiment based on such a concept is given in FIG. 4.

However, because the refrigerant is in mixed phases, it is difficult to keep the pressure drop between each of the plate-fin heat exchangers and the corresponding separation drum uniform and small, and this adversely affects the heat transfer in the plate-fin heat exchangers. One of the reasons for not using plate-fin heat exchangers in this field can be attributed to the loss of the efficiency of heat transfer due to the imbalance in the pressure drop. In view of this fact, according to the present invention, separation drums which may consist of a thermo siphon drum are placed horizontally with their length extending in a lateral direction, and the separation drums are provided with the function of a header so that the conduits returning from the plate-fin heat exchanger to the separation drums may be directly connected thereto, one conduit for each unit of the heat exchanger. As a result, the overall pressure drop is reduced, and the heat transfer in each unit of the plate-fin heat exchanger is improved.

Figure 5:
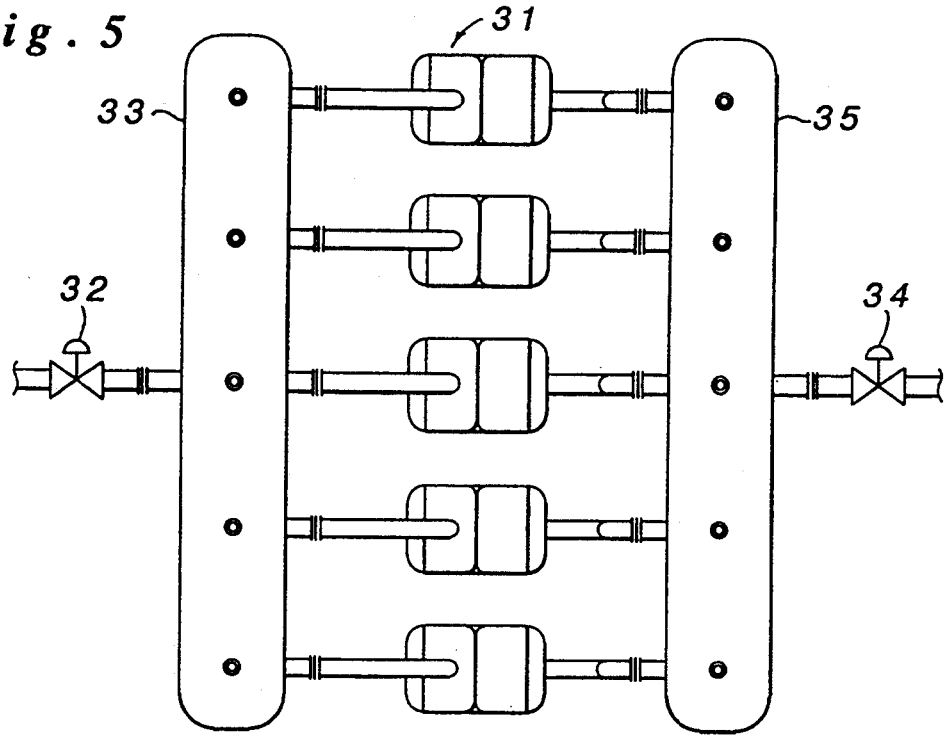
FIG. 5 is a plan view showing the layout of the system illustrated in FIG. 4.
Figure 6:
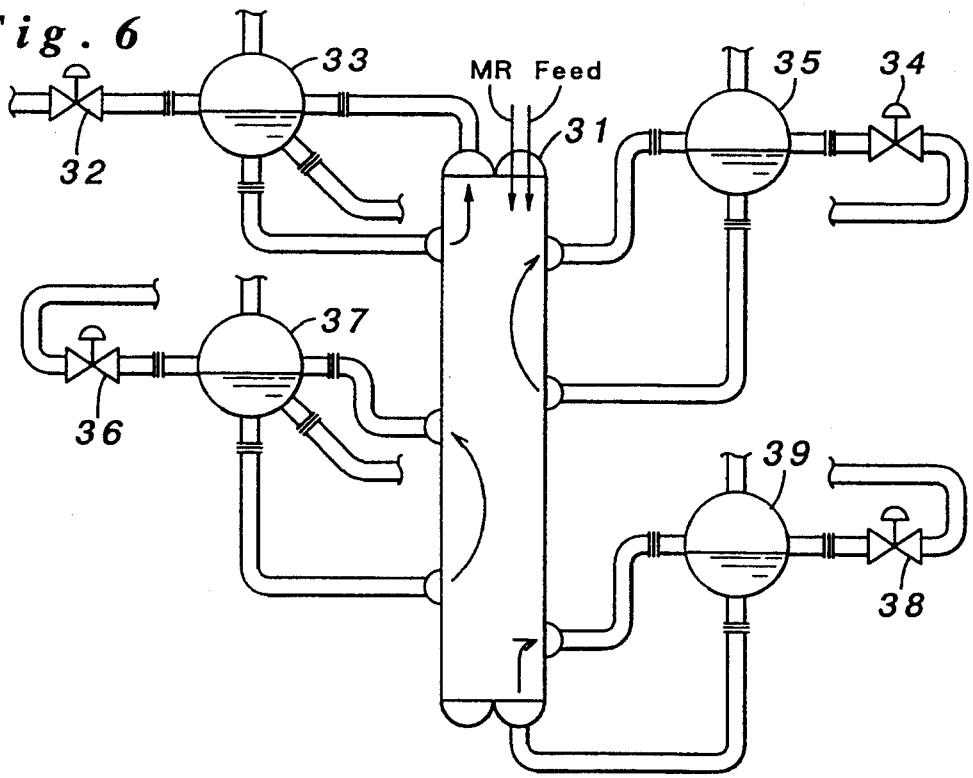
FIG. 6 is a vertical view showing the layout of the system illustrated in FIG. 4.

More specifically, as illustrated in FIGS. 5 and 6, five units of a vertical plate-fin heat exchanger 31 are placed one next to the other, and thermo siphon drums 33, 35, 37 and 39 are arranged laterally so that they may each serve as a common header to each segment of the plate-fin heat exchanger 31. In the present embodiment, the thermo siphon drums are provided one over the other on either side, or four thermo siphon drums for each unit of the plate-fin heat exchanger 31. Since the propane flows vertically, in particular, vertically upwards, and through a plurality of passages which are separated from each other throughout their length, even though the propane is in mixed phases, the pressure drop is not only minimized but also distributed evenly to different passages in the plate-fin heat exchanger. Meanwhile, the natural gas or the mixed refrigerant is passed as a vertical down flow or a horizontal flow, and by taking into account that it is in mixed phases, the passages of the natural gas and the mixed refrigerant in the plate-fin heat exchanger are preferably kept separate from each other over their entire length so that losses in the efficiency of heat transfer may be avoided.

Figure 7:
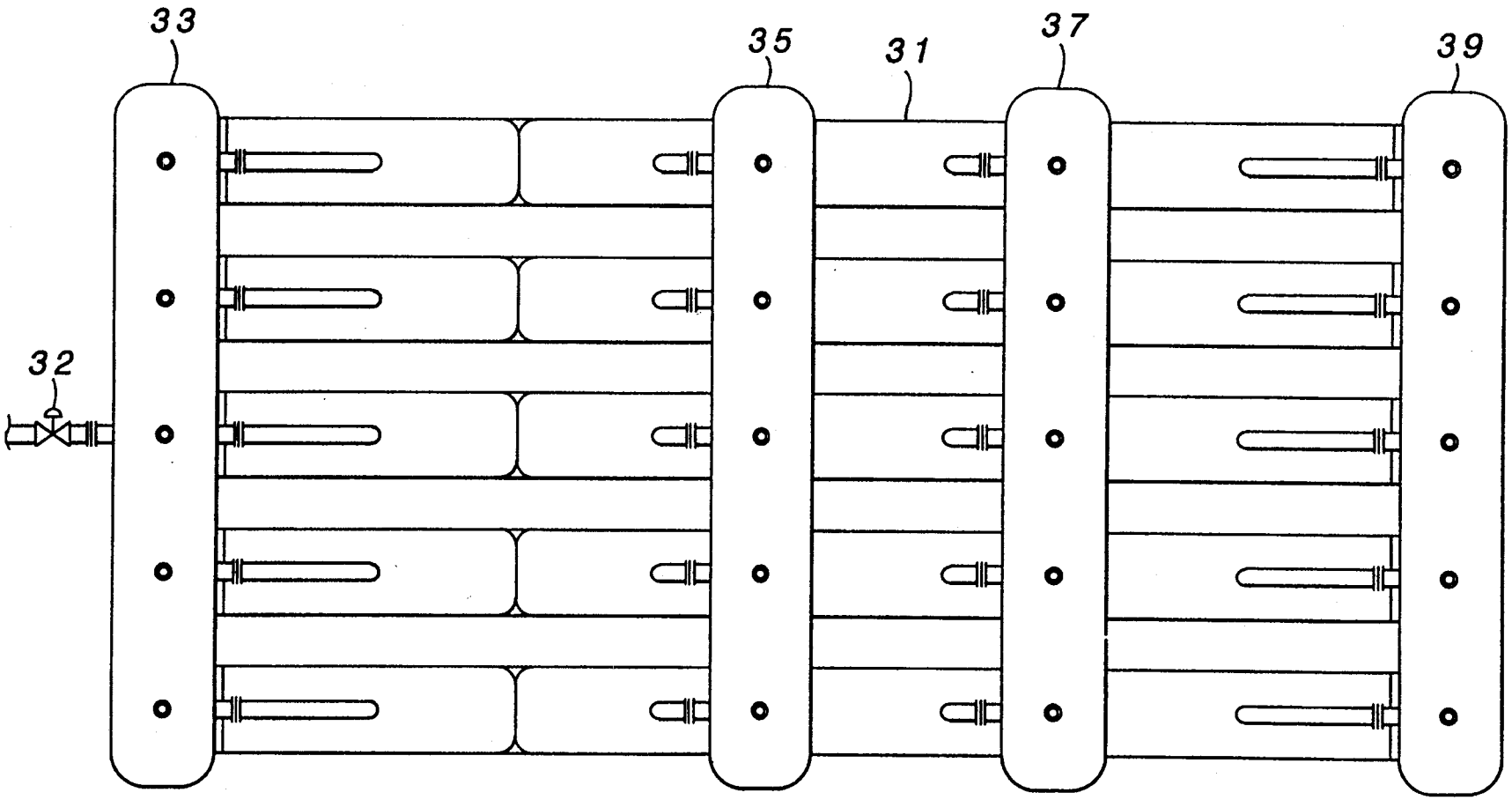
FIG. 7 is a plan view of a third embodiment of the refrigeration system according to the present invention.
Figure 8:
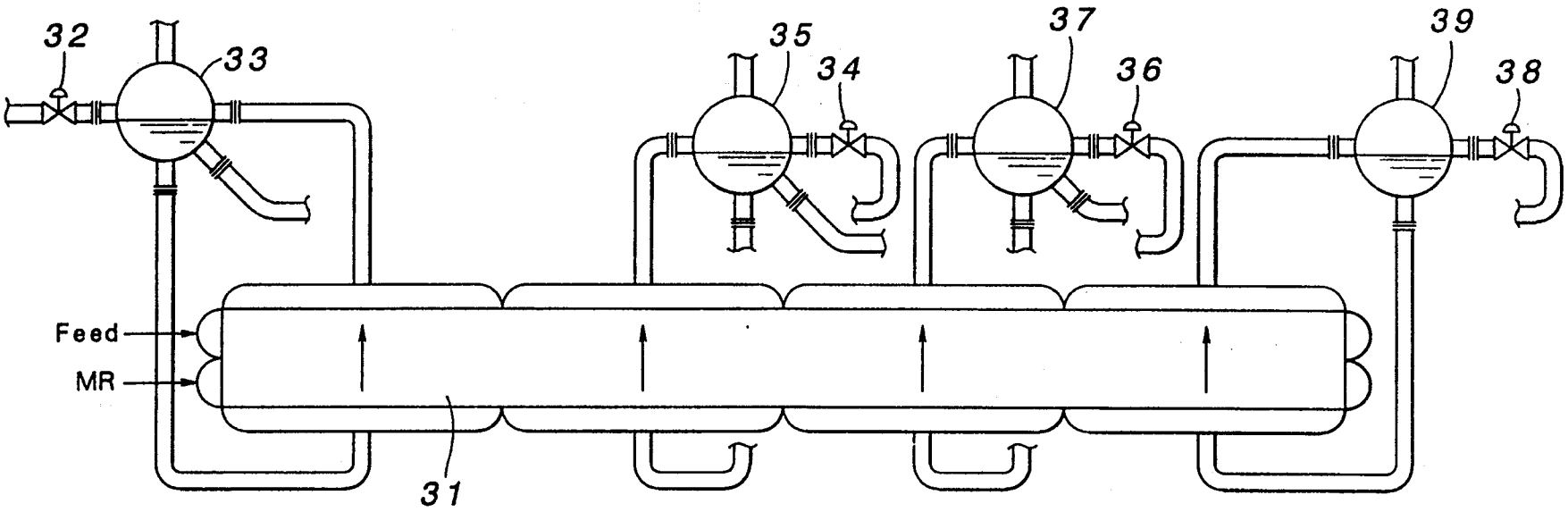
FIG. 8 is a vertical view of the third embodiment of the refrigeration system according to the present invention.

FIGS. 7 and 8 show a third embodiment of the present invention. The parts corresponding to those of the previous embodiments are denoted with like numerals, and the description of such parts are not repeated here.

In this case, a plate-fin heat exchanger 31 is placed horizontally, and natural gas or a mixed refrigerant is passed horizontally while a propane refrigerant is passed vertically upward. The separation drums 33, 35, 37 and 39 serving as thermo siphon drums are placed horizontally in the same manner as in the second embodiment. Similarly, the separation drums are each provided with the function of a header so that the conduits returning from the plate-fin heat exchanger to the separation drums are directly connected thereto with the individual conduit from each unit of the heat exchanger being connected to a corresponding one of the separation drums so that the overall pressure drop may be not only reduced but also evenly distributed among the different passages in the plate-fin heat exchanger, and the heat transfer efficiency of the heat exchanger may be improved.

Because natural gas or a mixed refrigerant is passed horizontally in the heat exchanger, and the condensate of the stream tends to be separated in a lower part of the heat exchanger during the cooling process therein, thereby impairing the heat transfer efficiency of the heat exchanger, it is necessary to use straight fins in the plate-fin heat exchanger.

Straight fins have a relatively lower coefficient of heat transfer as compared to perforated fins normally used for condensing upward or downward flow, but straight fins may require less space because the passage of the coolant or the propane refrigerant may be increased in size, and distributor for each level of the propane may be omitted, thereby increasing the effective area for heat transfer.

Figure 9:
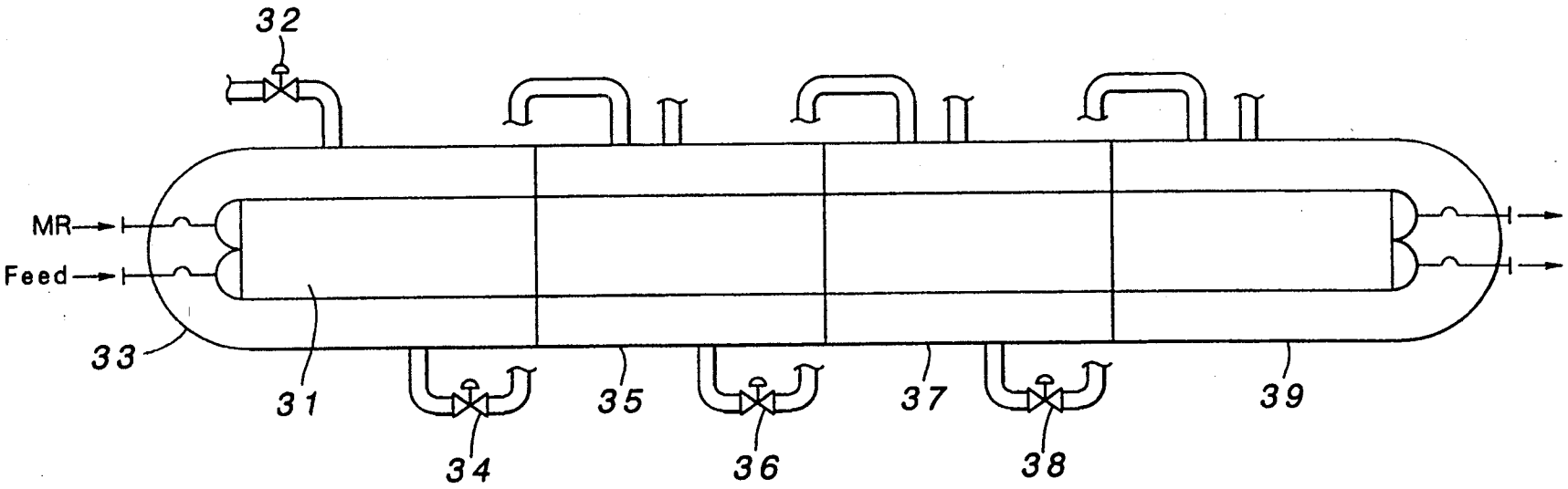
FIG. 9 is a side view of a fourth embodiment of the refrigeration system according to the present invention.
Figure 10:
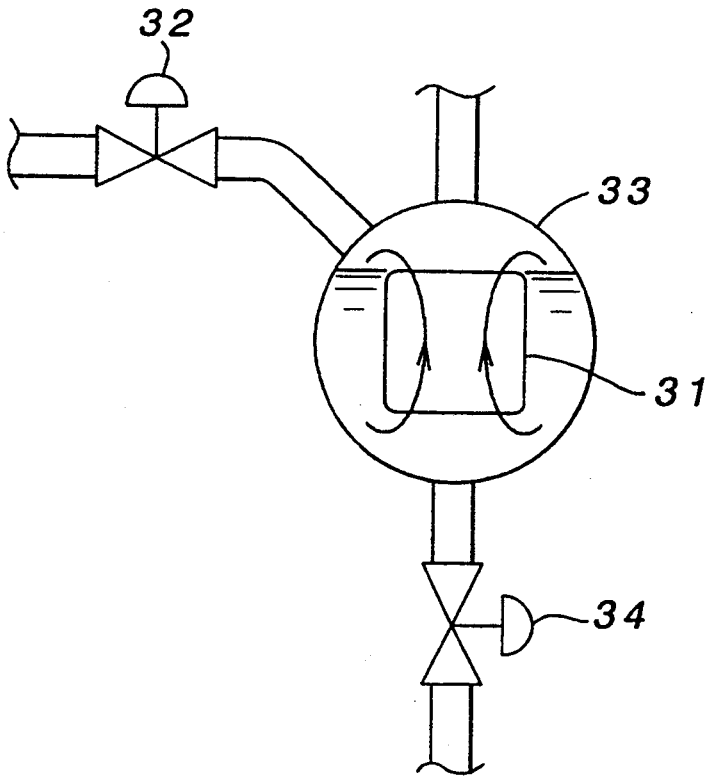
FIG. 10 is a sectional front view of the system illustrated in FIG. 9.

FIGS. 9 and 10 show a fourth embodiment of the present invention. The separation drums and the plate-fin heat exchanger were separately provided in the previous embodiments, but they are now combined into a single unit in the present embodiment. More specifically, the separation drums 33, 35, 37 and 39 are formed by separating a single elongated tank with partition walls, and the plate-fin heat exchanger 31 extends in all of the separation drums 33, 35, 37 and 39 across these partition walls. As illustrated in FIG. 10, in each of the separation drums, the heat exchanger is substantially submerged in the liquid part of the propane refrigerant, and the propane refrigerant is allowed to circulate across the heat exchanger 31 as a vertical upward thermo siphon flow by convection.

According to this embodiment, the internal structure of the separation drums is made somewhat more complex than those of the other embodiments, but, because of the substantial reduction in the piping requirements, the overall fabrication cost can be reduced, and the overall pressure loss can also be minimized. Further, by providing an appropriate number of such structures in parallel with each other, it is possible to attain a desired overall capacity. If desired, a plurality of heat exchanger units such as those used in the previous embodiments can be arranged in a single tank which is separated into separation drums by partition walls as required.

In a refrigeration system for pre-cooling natural gas or a mixed refrigerant for liquefying natural gas, by using plate-fin heat exchangers instead of shell and tube heat exchangers, and keeping the passages for the propane, the natural gas or the mixed refrigerant separate from each other, unevenness in the ratio of the gas content to the liquid content in different passages is reduced, and a high heat transfer efficiency and a substantial reduction in the equipment cost can be achieved. Further, by flowing the propane in the plate-fin heat exchanger as a vertical upward flow, and placing the associated thermo siphon drums horizontally, even when the propane is in mixed phases, the pressure drop can be not only reduced but also evenly distributed to different passages in the heat exchanger.

Although the present invention has been described in terms of specific embodiments thereof, it is possible to modify and alter details thereof without departing from the spirit of the present invention.

What is claimed is:

1. A cooling system suitable for use in a refrigeration system for pre-cooling natural gas or cooling a mixed refrigerant for liquefying natural gas by using a propane refrigerant in a natural gas liquefaction process, comprising:

a plate-fin heat exchanger including a plurality of passages for said natural gas or said mixed refrigerant which extend in a mutually separated relationship substantially over an entire length of said plate-fin heat exchanger, said propane refrigerant being passed vertically in said plate-fin heat exchanger; and a separation drum for said propane refrigerant consisting of a laterally elongated, horizontally disposed tank connected to said plate-fin heat exchanger;

said plate-fin heat exchanger comprising a plurality of units disposed substantially parallel to each other wherein each of said units defines at least one of said passages, and said separation drum extends laterally across said units with conduits that connect said units with said separation drum extending in a mutually parallel relationship.

2. A system according to claim 1, wherein a plurality of separation drums are provided, and each separation drum is connected to said plate-fin heat exchanger so as to serve also as a common header for said plurality of units of said plate-fin heat exchanger.

3. A system according to claim 2, wherein said plate-fin heat exchanger is placed vertically such that each of said units may extend vertically, and said separation drums extend horizontally laterally across said units at least on one side of said plate-fin heat exchanger.

4. A system according to claim 2, wherein said plate-fin heat exchanger is placed horizontally such that each of said units may extend horizontally, and said separation drums extend horizontally and laterally across said units of said plate-fin heat exchanger.

5. A system according to claim 1, wherein a plurality of separation drums arranged in a horizontal single row are defined by separating a single tank with partition walls, and said plate-fin heat exchanger defining mutually separated passages for said natural gas or said mixed refrigerant extends in a lengthwise direction of said passages through said separation drums across said partition walls and is substantially submerged in a liquid part of said propane refrigerant in each of said separation drums.

6. A system according to claim 1, wherein said separation drum consists of a thermo siphon drum.

7. A refrigeration system for pre-cooling natural gas or cooling a mixed refrigerant for liquefying natural gas by using a propane refrigerant in a natural gas liquefaction process, comprising:

a supply source of a propane refrigerant;

an expansion device for depressurizing said propane refrigerant supplied from said supply source;

a separation drum for separating said propane refrigerant obtained from said expansion device into a gas fraction and a liquid fraction;

a heat exchanger for cooling natural gas or a mixed refrigerant for liquefying natural gas by using said propane refrigerant obtained from said separation drum as a boiling liquid, and returning said propane refrigerant consisting of a mixture of vapor and liquid after exchanging heat to said separation drum;

a next-stage expansion device for extracting and depressurizing a part of said propane refrigerant obtained as liquid from said separation drum;

a next-stage separation drum for separating said propane refrigerant obtained from said next-stage expansion device as a mixture of vapor and liquid into a gas fraction and a liquid fraction;

a next-stage heat exchanger for cooling natural gas or a mixed refrigerant for liquefying natural gas with said propane refrigerant obtained from said next-stage separation drum as boiling liquid, and returning said propane refrigerant consisting of a mixture of vapor and liquid after exchanging heat to said next-stage separation drum; and a vapor conduit for returning said propane refrigerant obtained from said next-stage separation drum as vapor to said supply source;

said heat exchangers each consisting of a plate-fin heat exchanger in which a plurality of passages for said natural gas or said mixed refrigerant extend over an entire length thereof in mutually separated relationship with said propane refrigerant being passed vertically in said plate-fin heat exchanger;

said separation drums each consisting of a horizontally disposed, laterally elongated drum connected to said corresponding plate-fin heat exchanger as a thermo siphon drum for said propane refrigerant.

8. A cooling system suitable for use in a refrigeration system for pre-cooling natural gas or cooling a mixed refrigerant for liquefying natural gas by using a propane refrigerant in a natural gas liquefaction process, comprising:

a plate-fin heat exchanger including a plurality of passages for said natural gas or said mixed refrigerant which extend in a mutually separated relationship substantially over an entire length of said plate-fin heat exchanger, said propane refrigerant being passed vertically in said plate-fin heat exchanger;

a plurality of separation drums for said propane refrigerant defined inside a laterally elongated, horizontally disposed tank separated by a plurality of partition walls, said separation drums being connected to said plate-fin heat exchanger; and said plate-fin heat exchanger extending in a lengthwise direction of said passages through said separation drums across said partition walls and substantially submerged in a liquid part of said propane refrigerant in each of said separation drums.

9. A system according to claim 6, wherein said thermo siphon drum also serves as a flash tank.

* * * * *